US007119274B2

(12) United States Patent
Bello

(10) Patent No.: US 7,119,274 B2
(45) Date of Patent: Oct. 10, 2006

(54) SUBMERSIBLE PUMP CABLE WITH CONDUCTIVE AIR LINE

(76) Inventor: Paul Bello, 525 21st NE., Salem, OR (US) 97301

( * ) Notice: Subject to any disclaimer, the term of this patent is extended or adjusted under 35 U.S.C. 154(b) by 0 days.

(21) Appl. No.: 11/133,941

(22) Filed: May 20, 2005

(65) Prior Publication Data

US 2006/0042818 A1 Mar. 2, 2006

Related U.S. Application Data

(63) Continuation-in-part of application No. 10/925,665, filed on Aug. 24, 2004.

(51) Int. Cl.
*H01B 7/34* (2006.01)

(52) U.S. Cl. ..... 174/36

(58) Field of Classification Search ..... 174/36, 174/110 R, 113 R, 117 R, 117 F, 117 FF
See application file for complete search history.

(56) References Cited

U.S. PATENT DOCUMENTS 3,603,718 A * 9/1971 Gedenk ..... 174/47
4,314,969 A * 2/1982 Arthur et al. ..... 422/82.01
4,842,023 A * 6/1989 Whitworth ..... 138/122
5,528,824 A * 6/1996 Anthony et al. ..... 29/828
5,553,666 A * 9/1996 Hartman ..... 166/60
5,557,698 A * 9/1996 Gareis et al. ..... 385/101
5,670,747 A * 9/1997 Lawer et al. ..... 174/74 R
6,005,221 A * 12/1999 Cusick, III ..... 219/137.62
6,298,917 B1 * 10/2001 Kobylinski et al. ..... 166/369
6,397,945 B1 * 6/2002 Manke et al. ..... 166/65.1

FOREIGN PATENT DOCUMENTS

JP 09-270209 A * 10/1997

OTHER PUBLICATIONS

[Brochure] *Submersible Pump Cable.* (2002). Kalas Manufacturing Incorporated (Ground Water Division) Denver, PA.

* cited by examiner

*Primary Examiner*—William H. Mayo, III
(74) *Attorney, Agent, or Firm*—Marger Johnson & McCollom, P.C.

(57) ABSTRACT

A submersible pump cable includes a conductive air line that is configured to transport both an electrical current and pressurized air.

13 Claims, 3 Drawing Sheets

SUBMERSIBLE PUMP CABLE WITH CONDUCTIVE AIR LINE

CROSS REFERENCE TO RELATED APPLICATIONS

This application is a continuation-in-part of copending U.S. application Ser. No. 10/925,665, filed on 24 Aug. 2004, entitled SUBMERSIBLE PUMP CABLE WITH AIR LINE.

BACKGROUND

1. Technical Field

This disclosure relates in general to submersible cables for pump applications, and more particularly, to improved submersible cables that have a combined air line and electrical lead.

2. Description of the Related Art

Submersible pump cable is well-known in the art. As the name implies, submersible pump cable is used to supply electrical power to submersible pumps. Submersible pump cable is used within the well casing, and a typical operating environment with temperatures between −40° and 75° C., in circuits not exceeding 600 V. One type of submersible pump cable, known as the twisted type, consists of four copper conductors, either solid or stranded, that are insulated with a PolyVinyl Chloride (PVC) sheath. The conductors and their PVC sheaths have a circular cross-section. One of the conductors is typically used as a ground connection. The four conductors, with their associated sheaths, are twisted around each other to form the submersible pump cable.

Another type of submersible pump cable used for heavy duty applications is the flat jacketed type. For this type of cable, each of the conductors and their PVC sheaths are laid out side-by-side, that is, parallel to each other. A flat PVC jacket is disposed around the outside of the circular PVC sheaths. The flat PVC jacket provides an additional measure of abrasion resistance.

Because the water table varies throughout the year, it is oftentimes desirable to know how much water is available to pump. For example, a submersible pump may be at the bottom of a well that is 300 feet deep. During a wet winter, the water table may be, for example, 50 feet below the ground surface. In other words, the pump is submerged under 250 feet of water. During a dry summer, however, the water table may drop, for example, by 50 feet. Consequently, the pump is now submerged under 200 feet of water.

Based upon the amount of water that is available, a pump may be adjusted to operate at a selected pumping rate. For example, one particular pump may be adjusted to pump between 5 gallons/minute to 100 gallons/minute. Other pumps may have different pumping rates. The fastest pumping rate might be used when the submerged depth of the pump is at a maximum and the slowest pumping rate might be used when the submerged depth of the pump is at a minimum.

A conventional way of determining how deep the pump is submerged below the surface of the water is by using an air line. The air line is nothing more than a hollow tube. One end of the air line is attached to the pump when it is submerged, but the end of the air line remains open to allow liquid and gas to pass through the end of the air line. The other end of the air line may be coupled to a pressure gauge and an air pump. The air pump is configured to occasionally pump air through the air line until all the liquid is expelled from the air line. The pressure gauge records the air pressure required to clear the liquid from the air line.

It is well known that 1 pound per square inch (p.s.i.) of pressure will raise a column of water by 2.31 feet. Conversely, a column of water 1 foot tall exerts a pressure of 0.434 p.s.i. Using these figures and the air pressure that was recorded by the pressure gauge, a calculation of the depth that the pump is submerged may be obtained. For example, if the pressure gauge records a pressure of 27.0 p.s.i., the pump lies submerged at a depth of 63.0 feet [(27.0 p.s.i.)×(2.31 feet/p.s.i.)=62.99 feet].

Currently, conventional air lines and conventional submersible pump cables are manufactured separately. Embodiments of the invention address this and other disadvantages of the conventional art.

DETAILED DESCRIPTION

Embodiments of the invention provide a combined submersible pump cable and air line. Consequently, the air line benefits from being protected by one or more of the conductors, PVC sheathing, and/or PVC jacket of the submersible pump cable. By incorporating the pump cable and air line into one combined cable, embodiments of the invention provide additional convenience and increased protection to the air line compared to the conventional art.

In the following detailed description, numerous exemplary embodiments of the invention will be described with reference to the attached FIGURES. Although the specification below may refer to "an", "one", "another", or "some" embodiment(s) in several locations, this does not necessarily mean that each such reference is to the same embodiment(s), or that the feature described only applies to a single embodiment.

Figure 1:
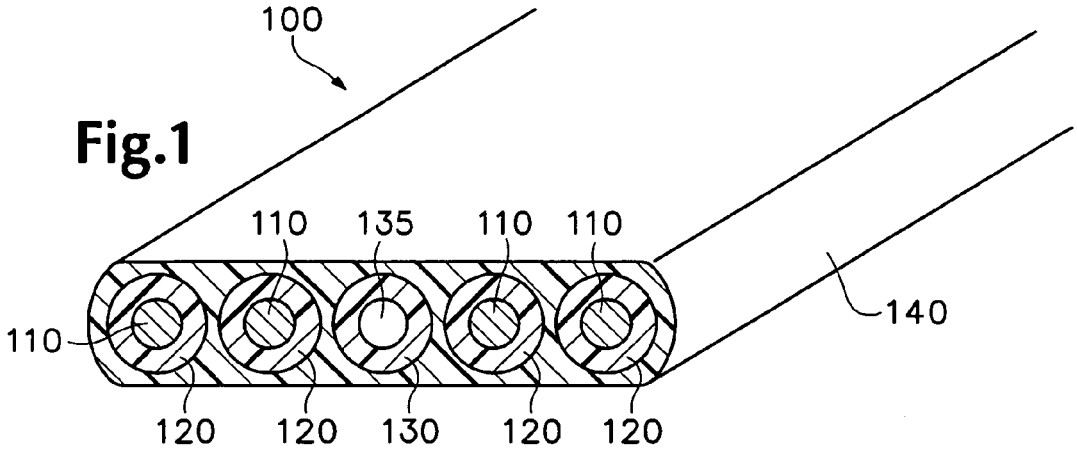
FIG. 1 is a perspective diagram illustrating a flat jacket submersible pump cable that is combined with an air line according to some embodiments of the invention.

FIG. 1 is a perspective diagram illustrating a flat jacket submersible pump cable that is combined with an air line according to some embodiments of the invention.

The submersible pump cable 100 includes four conductors 110 and one air line 130. The conductors 110 may be composed of a single large copper wire or many small strands of copper wire twisted together. In alternative embodiments other metals may be used to form the conductors 110.

The conductors 110 are surrounded by PVC sheaths 120 that have ring-shaped cross sections. As shown in FIG. 1, the air line 130 may itself be a PVC sheath that has a ring-shaped cross section. The air line 130 defines a circular void 135 that runs the length of the air line 130. The circular void 135 and the air line 130 together form the hollow tube that is used to measure the height of the water above the submersible pump.

The submersible pump cable 100 also includes a flattened PVC jacket 140 that is disposed around the PVC sheaths 120 and the air line 130. The PVC jacket 140 holds the PVC sheaths 120 and the air line 130 in a side by side, parallel configuration.

Although in these embodiments the air line 130 is positioned centrally among the conductors 110, alternative embodiments may have the air line 130 in a different position relative to the conductors 110 and PVC sheaths 120.

Consequently, according to the embodiments described above, a submersible pump cable 100 of the flat jacket type may also include an air line 130 within the PVC jacket 140, thus providing additional durability to the air line 130. Additional convenience is provided because the air line 130 is incorporated into the submersible pump cable 100, and the open end of the air line 130 is automatically positioned in a location that is in close proximity to the submerged pump. Thus, a conventional pressure gauge may be attached to the upper end of the air line 130 without the hassle of making sure that the end of a conventional air line is positioned in close proximity to the submerged pump or properly secured to a conventional pump cable.

Figure 2:
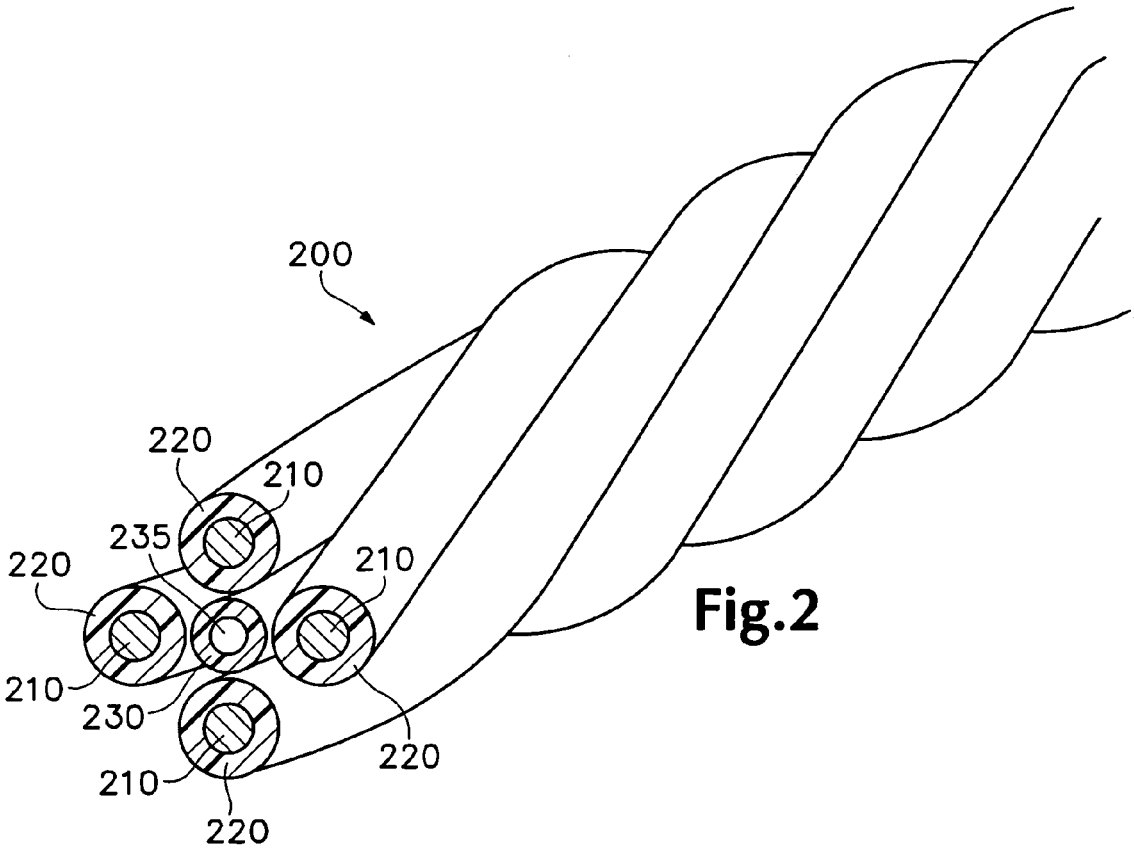
FIG. 2 is a perspective diagram illustrating a twisted submersible pump cable that is combined with an air line according to other embodiments of the invention.

FIG. 2 is a perspective diagram illustrating a twisted submersible pump cable that is combined with an air line according to other embodiments of the invention.

A submersible pump cable 200 includes four conductors 210 and one air line 230. The conductors 210 may be composed of a single large copper wire or many small strands of copper wire twisted together. In alternative embodiments other metals may be used to form the conductors 210.

The conductors 210 are surrounded by PVC sheaths 220 that have ring-shaped cross sections. The air line 230 may itself be a PVC sheath that has a ring-shaped cross section. The air line 230 defines a circular void 235 that runs the length of the air line 230. The circular void 235 and the air line 230 together form the hollow tube that is used to measure the height of the water above the submersible pump.

In the embodiments illustrated in FIG. 2, the conductors 210 and their protective PVC sheaths 220 are twisted around the air line 230, thereby protecting it from abrasion. This is the preferred embodiment. However, in alternative embodiments the air line 230 may be in a different position relative to the conductors 210 and PVC sheaths 220. That is, instead of being centrally located among the twisted conductors 210 and PVC sheaths 220, the air line 230 may itself be twisted together with the conductors 210 and sheaths 220.

Consequently, according to the embodiments described above, a submersible pump cable 200 of the twisted type may also include an air line 230 centrally located among the twisted conductors 110, thus providing additional durability to the air line 230. Additionally, since the air line 230 is now part of the submersible pump cable 200, the open end of the air line 230 is automatically positioned in a location that is in close proximity to the submerged pump. Thus, a conventional pressure gauge may be attached to the upper end of the air line 230 without the hassle of making sure that the end of a conventional air line is positioned in close proximity to the submerged pump or properly secured to a conventional pump cable.

Figure 3:
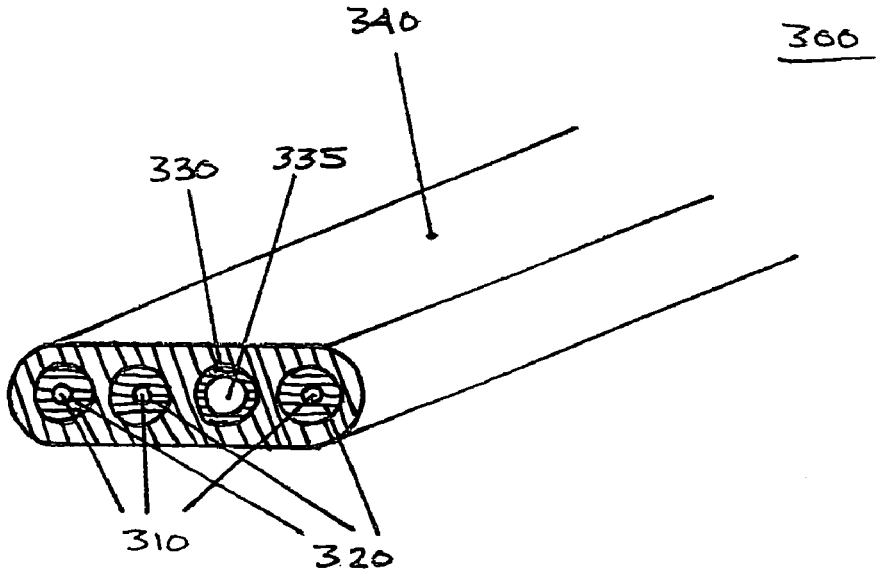
FIG. 3 is a perspective diagram illustrating a flat jacket submersible pump cable having a conductive air line according to some other embodiments of the invention.

FIG. 3 is a perspective diagram illustrating a flat jacket submersible pump cable 300 having a conductive air line 330 according to some other embodiments of the invention.

Referring to FIG. 3, the submersible pump cable 300 includes three conductors 310 and one conductive air line 330. The conductors 310 may be composed of a single large copper wire or many small strands of copper wire twisted together. The conductors 310 are surrounded by insulating sheaths 320 that have ring-shaped cross sections. In some embodiments of the invention, the insulating sheaths 320 may be composed of PVC.

The conductive air line 330 defines a circular void 335 that runs the length of the conductive air line. The circular void 335 and the conductive air line 330 together form the hollow tube that is used to measure the height of the water above the submersible pump. The conductive air line 330 may be composed of flexible copper tubing, or of some other conductive metal. Thus, the conductive air line 330 is used to supply an electrical signal to the submersible air pump as well as to measure the height of the water above the air pump.

The submersible pump cable 300 also includes a flattened insulating jacket 340 that is disposed around the insulating sheaths 320 and the conductive air line 330. The insulating jacket 340 holds the insulating sheaths 320 and the conductive air line 330 in a side by side, parallel configuration. In some embodiments of the invention, the insulating jacket 340 may be composed of PVC.

In alternative embodiments of the invention, one or more of the conductors 310 and its corresponding insulating sheath 320 may be replaced by another conductive air line 330. The total number of conductors 310 and conductive air lines 330 present in the submersible pump cable 300 may be more or less than the embodiment illustrated in FIG. 3.

According to other embodiments of the invention, a submersible pump cable may have a number of conductive air lines 330 and no conductors 310/insulating sheaths 320 whatsoever. In the event that one of the conductive air lines 330 was ever damaged to the point where it ceased to effectively conduct current and/or hold air, an unused conductive air line 330 may be used. For example, for a conventional submersible pump that required four electrical connections and one air tube, a submersible pump cable consisting of six conductive air lines 330 would provide five spare air tubes and two spare electrical connections.

Figure 4:
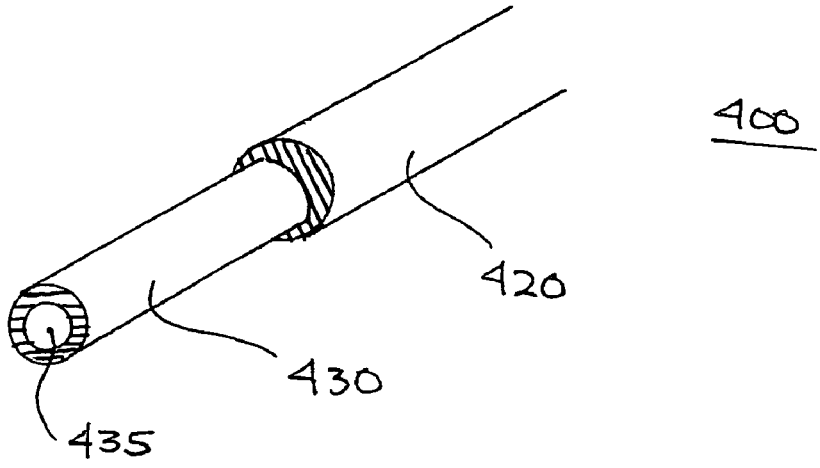
FIG. 4 is a perspective diagram illustrating a conductive air line suitable for use with submersible pump cables according to some other embodiments of the invention.

FIG. 4 is a perspective diagram illustrating another conductive air line 400 suitable for use with submersible pump cables according to still other embodiments of the invention.

According to these embodiments, the conductive air line 400 consists of a conductive metal sheath 420 covering an air line 430. In some embodiments, the air line 430 may be composed of plastic. The air line 430 defines a circular void 435 that runs the length of the air line. The circular void 435 and the air line 430 together form the hollow tube that is used to measure the height of the water above the submersible pump. In FIG. 4, the conductive metal sheath 420 is shown stripped off of the air line 430 for illustrative purposes.

The conductive metal sheath 420 covering the air line 430 preferably consists of a conductive metal such as, e.g., copper. The conductive metal sheath 420 is used to provide an electrical connection to an attached submersible pump (not shown). The conductive metal sheath 420 may increase the durability of the air line 430 by protecting it from abrasion. In alternative embodiments of the invention, the conductive metal sheath 420 may consist of a number of smaller, braided metal strands that surround the air line 430. For example, the conductive metal sheath 420 may consist of a braided copper sheath surrounding the air line 430.

The conductive air line 400 may be incorporated into a flat jacket type submersible pump cable, for example, like the submersible pump cable 100 of FIG. 1. In this case the flat jacket type submersible cable will have a flattened PVC jacket that is similar to the PVC jacket 140 of FIG. 1. The PVC jacket further protects the conductive air line 400 and also prevents the conductive metal sheath 420 from being exposed to the surrounding liquid.

In alternate embodiments, the conductive air line 400 may be incorporated into a twisted type submersible pump cable, for example, a twisted type submersible cable like the submersible pump cable 200 of FIG. 2. In this case the conductive air line 400 preferably has an additional insulative sheath (not shown) surrounding the conductive metal sheath 420 to further protect the air line 430 and also to prevent the conductive metal sheath 420 from being exposed to the surrounding liquid.

Figure 5:
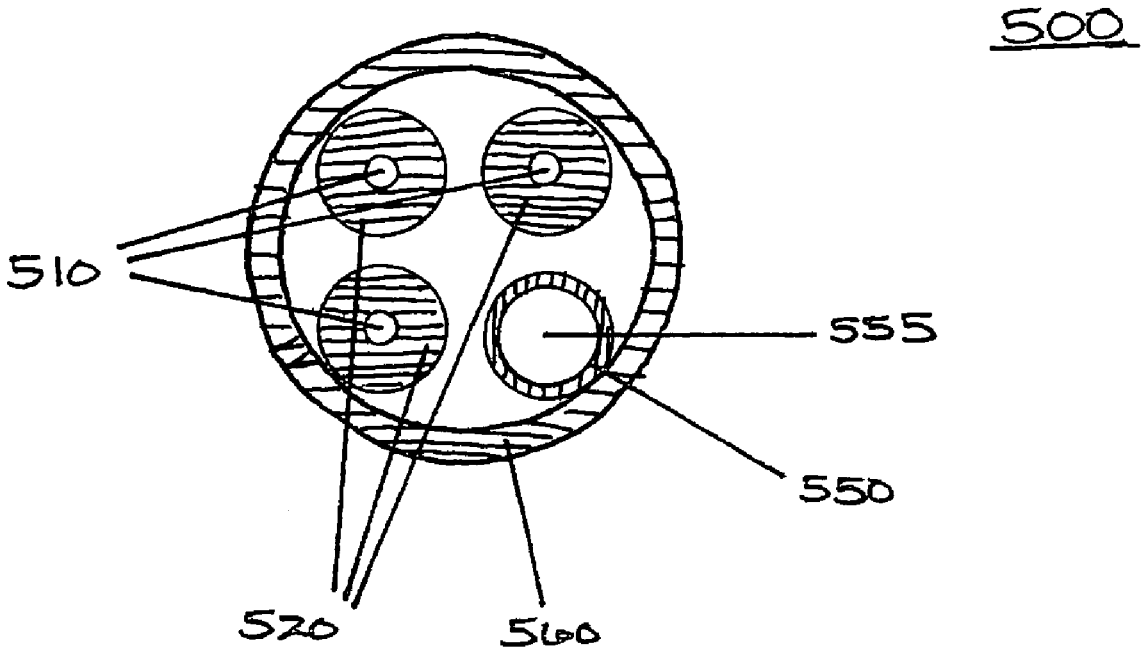
FIG. 5 is a cross-sectional diagram illustrating a twisted type submersible pump cable having a conductive air line according to some other embodiments of the invention.

FIG. 5 is a cross-sectional diagram illustrating a twisted type submersible pump cable 500 having a conductive air line 550 according to still other embodiments of the invention.

Referring to FIG. 5, the submersible pump cable 500 includes three conductors 510 and one conductive air line 550. The conductors 510 may be composed of a single large wire made of conductive metal, such as copper, or they may be composed of many smaller strands of conductive metal wire. The conductors 510 are surrounded by insulating sheaths 520 that have ring-shaped cross sections. In some embodiments of the invention, the insulating sheaths 520 may be composed of PVC.

The conductive air line 550 defines a circular void 555 that runs the length of the conductive air line. The circular void 555 and the conductive air line 550 together form the hollow tube that is used to measure the height of the water above the submersible pump. The conductive air line 550 may be composed of flexible copper tubing, or of some other conductive metal. Thus, the conductive air line 550 is used to supply an electrical signal to the submersible air pump as well as to measure the height of the water above the air pump.

Although not shown in FIG. 5, the conductive air line 550 and the conductors 510/insulating sheaths 520 are twisted around each other, similar to the submersible pump cable 200 illustrated in FIG. 2. Finally, an insulating jacket 560 surrounds the twisted conductive air line 550 and the insulating sheaths 520 to further protect the conductive air line 550. In some embodiments of the invention, the insulating jacket 560 may be composed of PVC.

Similar to the embodiments of the invention described in FIGS. 1 and 2, the embodiments described in FIGS. 3, 4, and 5 incorporate an air line directly into the submersible pump cable.

Having described several exemplary embodiments of the invention, it should be apparent that modifications and variations of the described embodiments that do not depart from the inventive concepts disclosed above will be obvious to those of skill in the art.

For example, the flat jacket type of submersible pump cable and the twisted type of submersible pump cable described above are just two examples of submersible pump cables. Other embodiments of the invention may include an air line together with another type of submersible pump cable.

As yet another example, embodiments of the invention may also include more than one air line in the submersible pump cable. This would provide a backup air line if one of them became damaged or clogged.

As another example, in the embodiments described above with respect to FIG. 1 the protective PVC sheaths for the conductors had approximately the same diameter as the air line. In alternative embodiments, such as the embodiments described in FIG. 2, the diameter of the PVC sheaths may be smaller or larger than the diameter of the air line.

As another example, the embodiments described above were assumed to be used in water pumping application. However, the embodiments described above may work equally well in applications where a liquid other than water is being pumped.

Finally, it should be apparent that even though the embodiments described above used copper conductors and PVC for the insulating material, alternative embodiments may use conductors of different metals and insulating material of different types.

Consequently, the scope of the invention should not be limited only to the embodiments described above, but to all embodiments as defined and encompassed by the attached claims.

I claim:

1. A submersible pump cable comprising:

a conductive air line configured to transport both electrical current and pressurized air, the conductive air line including a hollow tube composed of a flexible metal, the hollow tube having a longitudinal axis running lengthwise through a center of the hollow tube, the hollow tube having a radially outer surface relative to the longitudinal axis; and an insulating material that surrounds the hollow tube throughout a length of the hollow tube, the insulating material disposed in physical contact with an entirety of the radially outer surface of the hollow tube throughout the length of the hollow tube.

2. The submersible pump cable of claim 1, the conductive air line further comprising a hollow PVC tube within the hollow tube.

3. The submersible pump cable of the hollow tube composed of braided individual metal strands.

4. The submersible pump cable of claim 3, the metal strands consisting of copper.

5. The cable of claim 1, the insulating material consisting of an insulating jacket having a flattened cross-section.

6. The cable of claim 1, the insulating material consisting of an insulating jacket having a ring-shaped cross-section.

7. A submersible pump cable comprising:

a conductive air line structured to transport both electrical and pressurized air;

an insulating material surrounding a length of the conductive air line, the conductive air line having an outer surface and an inner surface that are continuous along the length of the conductive air line and continuous along a cross section of the conductive air line, the cross section taken in a direction perpendicular to the length, the insulating material disposed in physical contact with an entirely of the outer surface of the conductive air line along the length of the conductive air line.

8. The submersible pump cable of claim 7, the insulating material consisting of an insulating sheath, the insulating sheath having a ring-shaped cross-section.

9. The submersible pump cable of claim 8, the conductive air line comprising a hollow metal tube.

10. The submersible pump cable of claim 9, the conductive air line further comprising a hollow PVC tube within the hollow metal tube, the hollow PVC tube having a length and the hollow metal tube having a length, the hollow PVC tube and the hollow metal tube disposed such that an entire radially outer surface of the hollow PVC tube along the length of the hollow metal tube is disposed in physical contact with a radially inner surface of the hollow metal tube.

11. The submersible pump cable of claim 10, the hollow metal tube composed of braided strands of metal.

12. The submersible pump cable of claim 11, the braided strands of metal consisting of copper.

13. The submersible pump cable of claim 8, the insulating material consisting of an insulating jacket having a flattened cross-section.

* * * * *